US006896594B2

(12) United States Patent
Tsao et al.

(10) Patent No.: US 6,896,594 B2
(45) Date of Patent: May 24, 2005

(54) METHOD FOR GRINDING LENS

(75) Inventors: Yi-Chang Tsao, Hsinchu (TW); Wen-Chang Lin, Rende Shiang, Tainan County (TW)

(73) Assignee: AU Optronics Corp., Hsinchu (TW)

( * ) Notice: Subject to any disclaimer, the term of this patent is extended or adjusted under 35 U.S.C. 154(b) by 0 days.

(21) Appl. No.: 10/831,982

(22) Filed: Apr. 26, 2004

(65) Prior Publication Data

US 2005/0075054 A1 Apr. 7, 2005

(30) Foreign Application Priority Data

Oct. 3, 2003 (TW) ..... 92127520 A

(51) Int. Cl.[7] ..... B24B 1/00
(52) U.S. Cl. ..... 451/42; 451/59; 451/37
(58) Field of Search ..... 451/41, 42, 43, 451/44, 59, 60, 388, 289, 240, 255, 256, 451/277, 323

(56) References Cited

U.S. PATENT DOCUMENTS

| | | | | |
|---|---|---|---|---|
| 4,598,502 | A | 7/1986 | Lombard | |
| 5,906,532 | A * | 5/1999 | Nakajima et al. | 451/41 |
| 6,276,998 | B1 * | 8/2001 | Sommer et al. | 451/41 |

* cited by examiner

*Primary Examiner*—Dung Van Nguyen
(74) *Attorney, Agent, or Firm*—Thomas, Kayden, Horstemeyer & Risley

(57) ABSTRACT

A method for grinding lens is provided in the invention. First, a lens which has an optical surface and a surface-to-be-grinded is placed on a polishing pad. Next, cover up the lens with a fluid guiding tube wherein the fluid guiding tube has a fluid inlet and a fluid outlet with the fluid outlet being situated at the top of the polishing pad for accommodating the lens. After that, a fluid is introduced into the fluid guiding tube through the fluid inlet and is discharged from the fluid outlet, and the flow of the fluid follows the normal direction of the optical surface and applies force evenly thereon. Last, the polishing pad is moved along with the tangent line of its surface for the surface-to-be-grinded to be grinded.

14 Claims, 4 Drawing Sheets

METHOD FOR GRINDING LENS

This application claims the benefit of Taiwan application Serial No. 092127520, filed Oct. 3, 2003, the subject matter of which is incorporated herein by reference.

BACKGROUND OF THE INVENTION

1. Field of the Invention

The invention relates in general to a method for grinding lens, and more particularly to a method for grinding lens without mechanic contact.

2. Description of the Related Art

Of today's laser processing technology, gas laser has been widely used in drilling, cutting, engraving, welding, material heat treatment, and so on. In the technology of gas laser, gas is used as an active medium and is sealed inside a resonant cavity. The resonant cavity consists of two pieces of lens: the front one is a semi-reflecting lens while the rear one is a total-reflecting lens. Each of the two lenses has an optical surface and a gas contact surface, wherein the gas contact surface contacts with the gas which is sealed inside the resonant cavity. The operation of gas laser is that when a voltage or a current passes through an optical resonant cavity, the gas will be excited to create a monochromatic narrow light-beam of high homology which can be focused on a tiny spot with great precision for laser processing. The oscillation frequency of the laser light has much to do with the penetration rate of the lens used in the resonant cavity, i.e., the lower the penetration rate, the higher the oscillation frequency.

It is noteworthy that after a period of gas laser operation some blemishes or spots which severely affect lens quality will be formed on the gas contact surface of the lens, so the lens needs to be replaced after a certain period of operation. Since the lens used in gas laser is very expensive, lens replacement is a big expenditure for gas laser operation. As shown in FIG. 1, since optical surface 13 of lens 12 is so sensitive that an operator cannot use any mechanic tool for polishing pad 15 to grind surface-to-be-grinded 14, the other side of lens corresponding to optical surface 13. Even if force is applied from the lateral side of the lens, the conventional grinding method with mechanic contact still cannot apply the force evenly to achieve an even grinding. That is to say, when polishing pad 15 moves along with the direction of arrow 50 in FIG. 1, surface-to-be-grinded 14 will not be able to move in parallel to polishing pad 15 due to the force coming from the lateral side of lens 12. Particularly, the higher the level of evenness required is, the poorer the result of the above method will be.

SUMMARY OF THE INVENTION

It is therefore an object of the invention to provide a lens grinding method, whose non-mechanic contact design of using fluid to apply force onto optical surface not only prevents the optical surface from being blemished when grinding the surface-to-be grinded but also improves lens utilization and hence reduces lens replacement expenditure.

It is therefore an object of the invention to provide a lens grinding method. First, a lens is placed on the surface of a polishing pad, wherein the lens has an optical surface and a surface-to-be-grinded corresponding to each other, and the surface-to-be-grinded contacts with the surface of the polishing pad. Next, cover up the lens with a fluid guiding tube wherein the fluid guiding tube has a fluid inlet and a fluid outlet corresponding to each other. The fluid outlet situated at the top of the polishing pad for accommodating the lens has a plurality of baffles for contacting with the lateral side of the lens and for holding the lens accordingly. After that, a fluid is introduced into the fluid guiding tube through the fluid inlet and is discharged from the fluid outlet. The flow of the fluid follows the normal direction of the optical surface and applies force evenly thereon, so that a tight contact between the surface-to-be-grinded and the polishing pad can be created. Last, the polishing pad is moved along with the tangent line of its surface for the surface-to-be-grinded to be grinded.

It is therefore an object of the invention to provide a lens grinding method. First, a lens is placed on the surface of a polishing pad, wherein the lens has an optical surface and a surface-to-be-grinded corresponding to each other, and the surface-to-be-grinded contacts with the surface of the polishing pad. Next, cover the lens with a fluid guiding tube wherein the fluid guiding tube has a fluid inlet and a fluid outlet corresponding to each other. The fluid outlet situated at the top of the polishing pad for accommodating the lens has a plurality of baffles for contacting with the lateral side of the lens and for holding the lens accordingly. After that, a liquid is introduced into the fluid guiding tube through the fluid inlet and is discharged from the fluid outlet. The flow of the liquid follows the normal direction of the optical surface and applies force evenly thereon so that a tight contact between the surface-to-be-grinded and the polishing pad can be created. Following that, the polishing pad is moved along with the tangent line of its surface for the surface-to-be-grinded to be grinded. After that, halt the movement of the polishing pad when the grinding of the surface-to-be-grinded is finished. Last, halt the supply of the liquid then introduce a gas into the fluid guiding tube from the fluid inlet to dry the optical surface.

Other objects, features, and advantages of the invention will become apparent from the following detailed description of the preferred but non-limiting embodiments. The following description is made with reference to the accompanying drawings.

DETAILED DESCRIPTION OF THE INVENTION

The invention provides a lens grinding method for grinding the lens having an optical coat and a surface-to-be-grinded which correspond to each other. This method prevents the optical surface of the lens from being blemished when grinding the surface-to-be-grinded hence improves lens utilization and reduces lens replacement expenditure.

Figure 1:
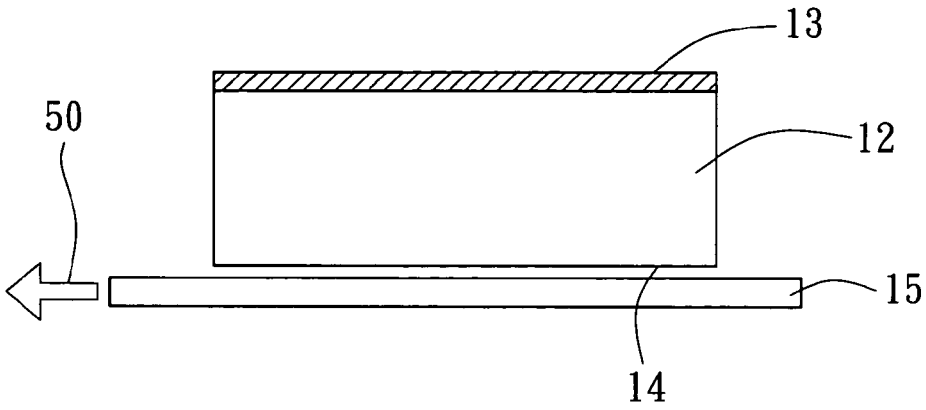
FIG. 1(PRIOR ART)
FIG. 1 is a sectional view of the lens and polishing pad for a conventional gas laser.
Figure 2:
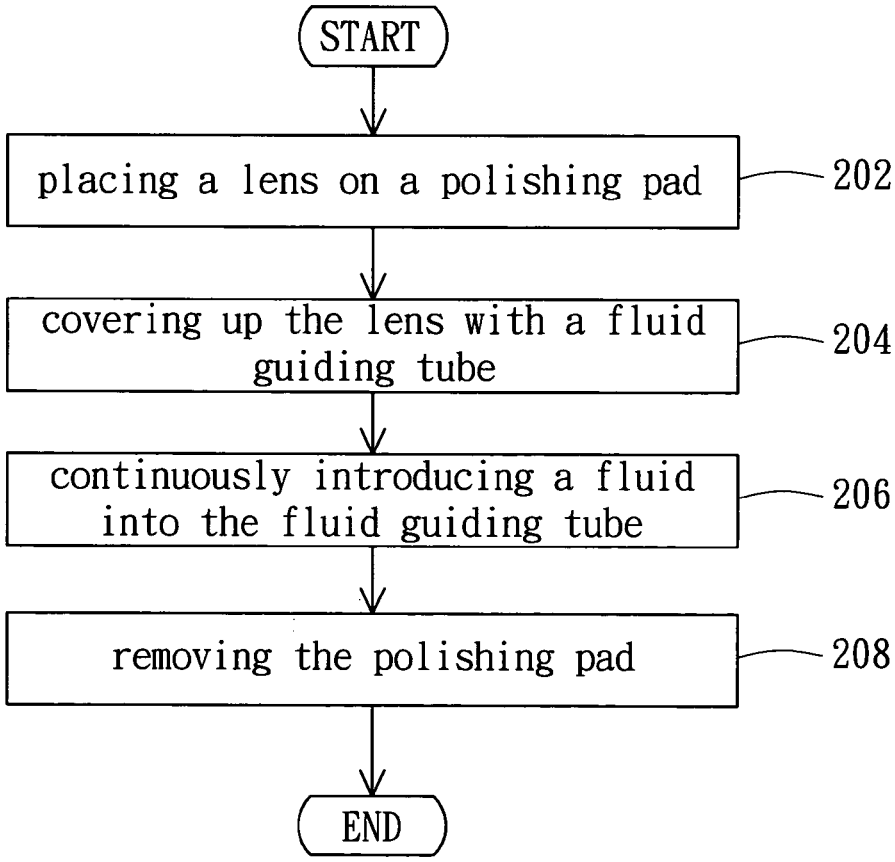
FIG. 2 is a flowchart showing the lens grinding method according to the preferred embodiment of the invention.
Figure 3:
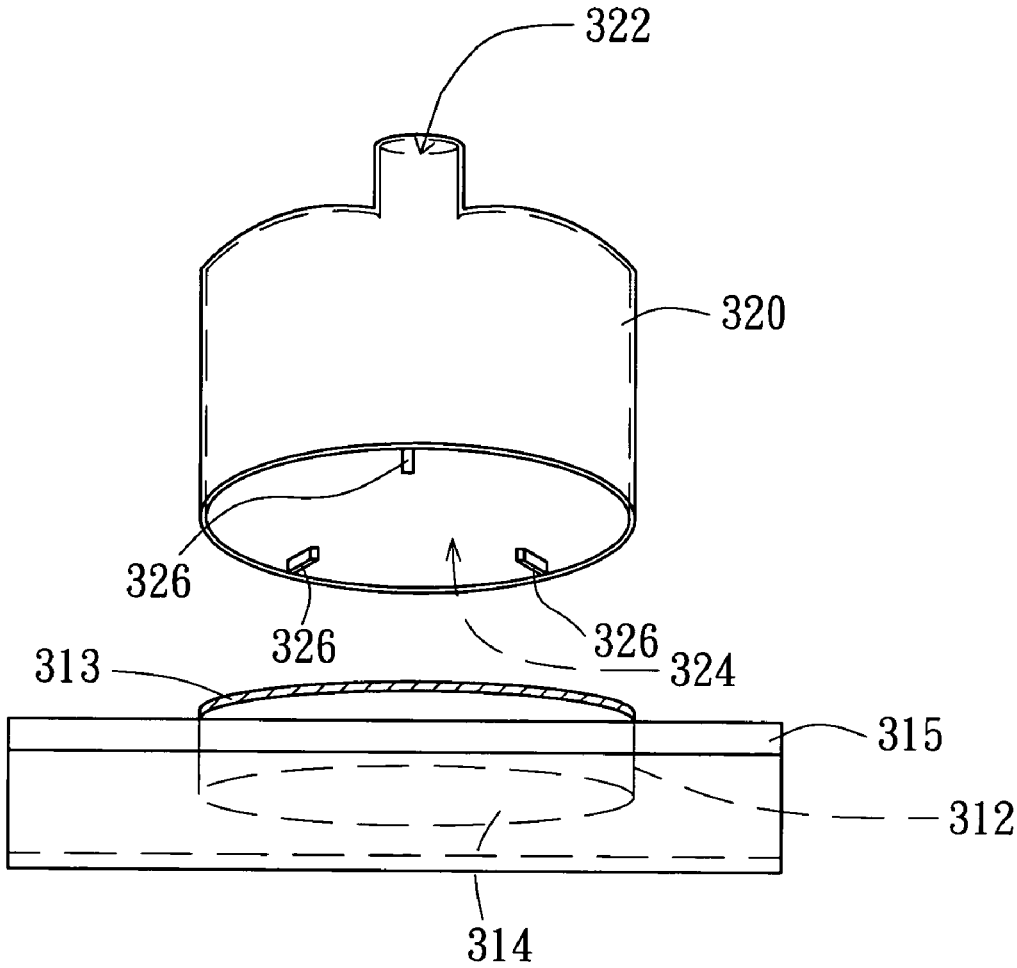
FIG. 3 is a three-dimensional diagram of the lens and fluid guiding tube situated at the top of the polishing pad according to the preferred embodiment of the invention.
Figure 4:
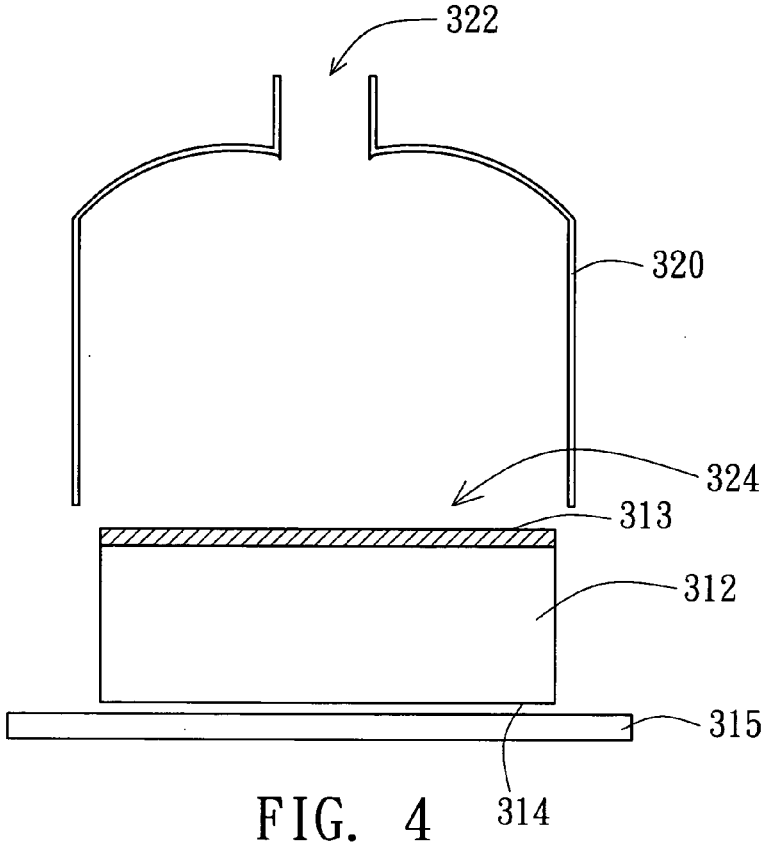
FIG. 4 is a sectional view of the lens and fluid guiding tube situated on the polishing pad in FIG. 3.
Figure 5:
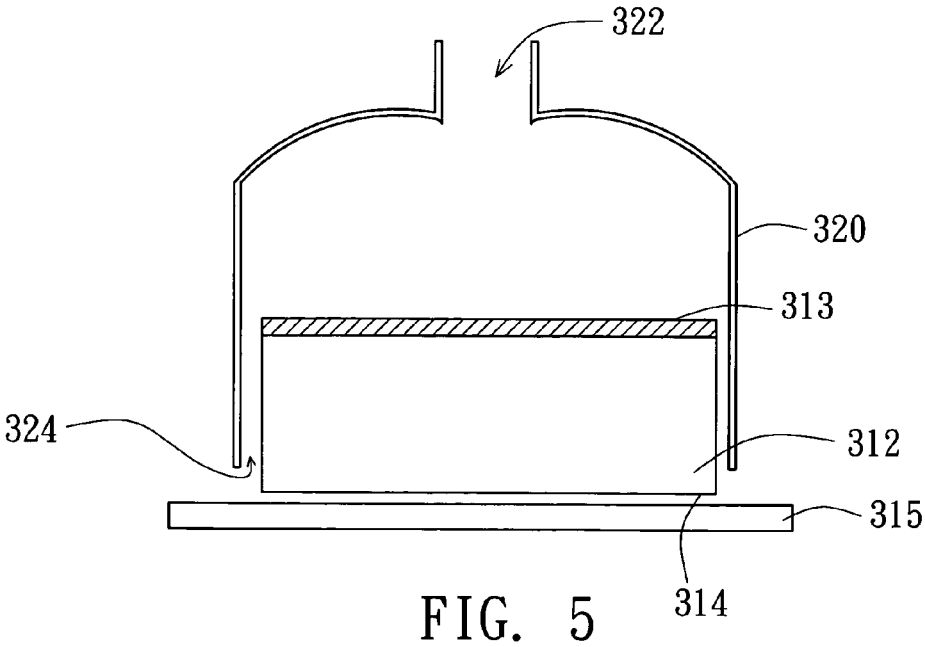
FIG. 5 is a combination section view of the lens and fluid guiding tube situated on the grinding packing in FIG. 4.

Referring to FIG. 2, a flowchart showing the lens grinding method according to the preferred embodiment of the invention. First, start with step 202: a lens 312 is placed on the surface of a polishing pad 315, wherein lens 312 has an optical surface 313 and a surface-to-be-grinded 314 corresponding to each other, and the surface-to-be-grinded contacts with the surface of the polishing pad as shown in FIG. 3 and FIG. 4. The optical surface 313 includes at least one optical thin film formed on the lens. Next, proceed to step 204: cover up lens 312 with a fluid guiding tube 320 wherein fluid guiding tube 320 has a fluid inlet 322 and a fluid outlet 324 corresponding to each other with fluid outlet 324 being situated at top of polishing pad 315 for accommodating lens 312 as shown in FIG. 5. The opening of fluid inlet 322 is smaller than that of fluid outlet 324 which has a plurality of baffles, three baffles 326 for instance, for contacting with the lateral side of lens 312 and for holding lens 312 accordingly.

Figure 6:
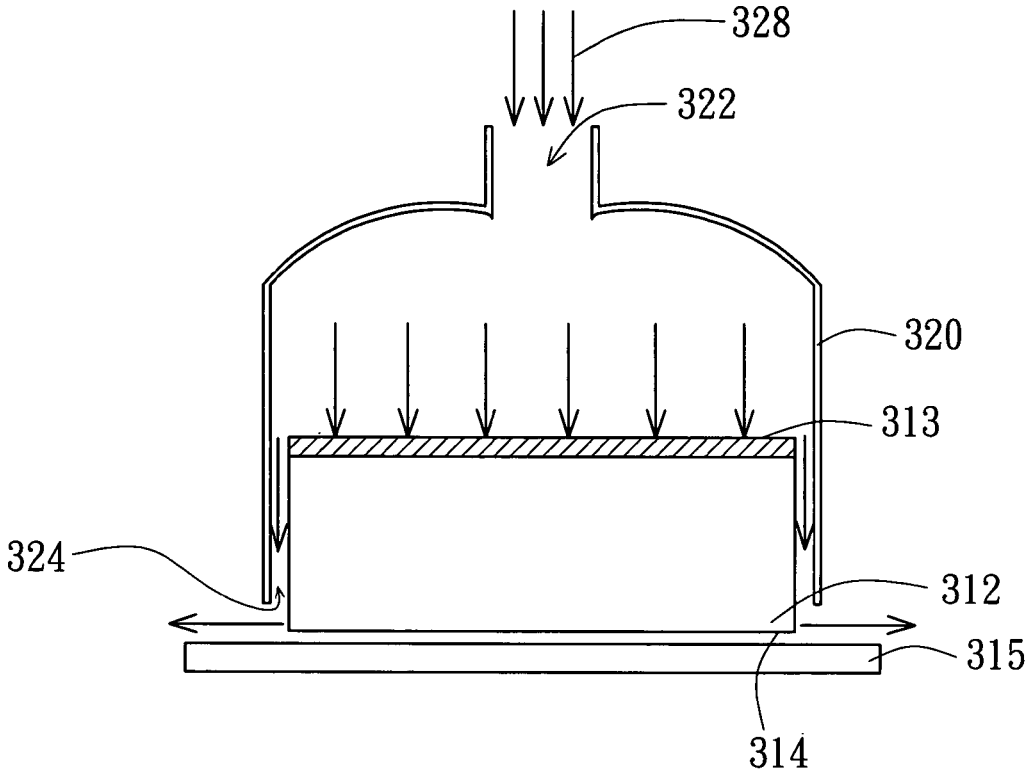
FIG. 6 is a sectional view showing the status a fluid is introduced into the fluid guiding tube in FIG. 5 and when the polishing pad grinds the surface-to-be-grinded.

After that, proceed to step 206: a fluid 328 is introduced into fluid guiding tube 320 through fluid inlet 322 and is discharged from fluid guiding tube 320 via the gap between fluid guiding tube 320 and the lateral side of lens 312 as well as via fluid outlet 324 as shown in FIG. 6. In FIG. 6, when flowing through fluid guiding tube 320, fluid 328 will lash against the surface of optical surface 313 and evenly apply force on the surface of optical surface 313 along with the normal direction thereof, so that a tight contact between surface-to-be-grinded 314 and polishing pad 315 can be created. The fluid 328 must not have any reaction with optical surface 313. Following that, polishing pad 315 is moved along with the tangent line of its surface for grinding surface-to-be-grinded 314.

Furthermore, lens 312 can be a lens used in gas laser or a lens supposed to be disposed. According to the invention, a lens supposed to be disposed in gas laser can be recycled to be further utilized after having been grinded again. Consequently, the lens replacement expenditure is reduced.

If fluid 328 is de-ionized water or other liquids, after surface-to-be-grinded 314 has been grinded, the invention can further comprise the following steps. First, halt the movement of polishing pad 315. Next, halt the supply of de-ionized water or other liquids then introduce a gas into fluid guiding tube 320 through fluid inlet 322 to dry optical surface 313, lest traces of water or other liquids might be left thereon. The gas used to dry optical surface 313 is a hot nitrogen gas.

The lens grinding method disclosed in the above preferred embodiment adopts a non-mechanic contact design, which uses fluid to apply force onto an optical surface, not only prevents the optical surface of the lens from being blemished when grinding the surface-to-be-grinded, but also improves lens utilization and hence reduces lens replacement expenditure.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method for grinding lens, comprising at least the steps of:

placing a lens on the surface of a polishing pad, wherein the lens has an optical surface and a surface-to-be-grinded corresponding to each other, and the surface-to-be-grinded contacts with the surface of the polishing pad;

covering up the lens with a fluid guiding tube, wherein the fluid guiding tube has a fluid inlet and a fluid outlet corresponding to each other, and the fluid outlet situated at the top of the polishing pad for accommodating the lens has a plurality of baffles for contacting with the lateral side of the lens and for holding the lens accordingly;

introducing a fluid into the fluid guiding tube through the fluid inlet continuously and simultaneously discharging the fluid from the fluid guiding tube through the fluid outlet, wherein the flow of the fluid follows the normal direction of the optical surface and applies force evenly thereon, so that a tight contact between the surface-to-be-grinded and the polishing pad can be created;

moving the polishing pad along with a tangent line of its surface for the surface-to-be-grinded to be grinded; and halting the supply of the liquid and then introducing a gas into the fluid guiding tube through the fluid inlet to dry the optical surface.

2. The method according to claim 1, wherein the fluid is a liquid.

3. The method according to claim 2, wherein the fluid is a de-ionized water.

4. The method according to claim 1, wherein the opening of the fluid inlet is smaller than that of the fluid outlet.

5. The method according to claim 1, wherein the lens is a lens applied in a gas laser.

6. A method for grinding lens, comprising at least the steps of:

placing a lens on the surface of a polishing pad, wherein the lens has an optical surface and a surface-to-be-grinded corresponding to each other, and the surface-to-be-grinded contacts with the surface of the polishing pad;

covering up the lens with a fluid guiding tube, wherein the fluid guiding tube has a fluid inlet and a fluid outlet corresponding to each other, and the fluid outlet situated at the top of the polishing pad for accommodating the lens has a plurality of baffles for contacting with the lateral side of the lens and for holding the lens accordingly introducing a fluid into the fluid guiding tube through the fluid inlet continuously and the fluid is discharged from the fluid outlet, wherein the flow of the fluid follows the normal direction of the optical surface and applies force evenly thereon, so that a tight contact between the surface-to-be-grinded and the polishing pad can be created;

moving the polishing pad along with the tangent line of its surface for the surface-to-be-grinded to be grinded, after the surface-to-be-grinded has been grinded, halting the movement of the polishing pad; and halting the supply of the liquid and introducing a gas into the fluid guiding tube through the fluid inlet to dry the optical surface.

7. The method according to claim 6, wherein the gas is a hot nitrogen gas.

8. The method according to claim 6, wherein the opening of the fluid inlet is smaller than that of the fluid outlet.

9. The method according to claim 6, wherein the lens is a lens applied in a gas laser.

10. A method for grinding lens, comprising at least the steps of:

placing a lens on the surface of a polishing pad, wherein the lens has an optical surface and a surface-to-be-grinded corresponding to each other, and the surface-to-be-grinded contacts with the surface of the polishing pad;

covering up the lens with a fluid guiding tube, wherein the fluid guiding tube has a fluid inlet and a fluid outlet corresponding to each other, and the fluid outlet situated at the top of the polishing pad for accommodating the lens has a plurality of baffles for contacting with the lateral side of the lens and for holding the lens accordingly;

introducing a liquid into the fluid guiding tube through the fluid inlet continuously and the liquid is discharged from the fluid outlet, wherein the flow of the liquid follows the normal direction of the optical surface and applies force evenly thereon, so that a tight contact between the surface-to-be-grinded and the polishing pad can be created;

moving the polishing pad along with the tangent line of its surface for the surface-to-be-grinded to be grinded;

halting the movement of the polishing pad after the surface-to-be-grinded has been grinded; and halting the supply of the liquid then introducing a gas into the fluid guiding tube through the fluid inlet to dry the optical surface.

11. The method according to claim 10, wherein the fluid is a de-ionized water.

12. The method according to claim 10, wherein the gas is a hot nitrogen gas.

13. The method according to claim 10, the wherein the opening of the fluid inlet is smaller than that of the fluid outlet.

14. The method according to claim 10, wherein the lens is a lens applied in gas laser.

* * * * *